US010947659B2

(12) United States Patent
Verburg

(10) Patent No.: US 10,947,659 B2
(45) Date of Patent: Mar. 16, 2021

(54) PIECE OF FURNITURE IN WHICH A WASHING MACHINE CAN BE PLACED AND METHOD FOR MANUFACTURE THEREOF

(71) Applicant: BFA Verburg B.V., Hengelo (NL)

(72) Inventor: Theodorus Jacobus Verburg, Hengelo (NL)

(73) Assignee: BFA Verburg B.V., Hengelo (NL)

( * ) Notice: Subject to any disclaimer, the term of this patent is extended or adjusted under 35 U.S.C. 154(b) by 0 days.

(21) Appl. No.: 16/339,535

(22) PCT Filed: Oct. 9, 2017

(86) PCT No.: PCT/EP2017/075693
§ 371 (c)(1),
(2) Date: Apr. 4, 2019

(87) PCT Pub. No.: WO2018/065631
PCT Pub. Date: Apr. 12, 2018

(65) Prior Publication Data

US 2019/0284747 A1 Sep. 19, 2019

(30) Foreign Application Priority Data

Oct. 8, 2016 (EP) ..... 16192967

(51) Int. Cl.
*D06F 39/12* (2006.01)
*A47B 88/40* (2017.01)
(Continued)

(52) U.S. Cl.
CPC ..... *D06F 39/12* (2013.01); *A47B 47/042* (2013.01); *A47B 77/08* (2013.01); *A47B 88/40* (2017.01);
(Continued)

(58) Field of Classification Search
CPC ..... A47B 77/04; A47B 77/08; A47B 2210/16; A47B 2210/17; A47B 2220/01; A47B 2220/03; D06F 39/12; D06F 29/00
See application file for complete search history.

(56) References Cited

U.S. PATENT DOCUMENTS 1,387,927 A * 8/1921 Hoffman ..... A47B 77/08 312/350
4,202,083 A * 5/1980 Gutner ..... A47B 91/024 248/300
(Continued)

FOREIGN PATENT DOCUMENTS

DE 2546302 A1 * 4/1977 ..... A47B 95/002
DE 3409972 A1 * 9/1985 ..... A47B 77/08
(Continued)

OTHER PUBLICATIONS

Translation DE3941687A1, 4 pages (Year: 1991).*
(Continued)

*Primary Examiner* — Andrew M Roersma
(74) *Attorney, Agent, or Firm* — The Webb Law Firm

(57) ABSTRACT

A piece of furniture in which a washing machine can be placed, comprising two substantially vertical side walls, a substantially horizontal bottom wall, a substantially horizontal top wall and a substantially horizontal carrier placed between the bottom wall and the top wall.

20 Claims, 3 Drawing Sheets

(51) Int. Cl.

| | |
|---|---|
| ***A47B 91/02*** | (2006.01) |
| ***A47B 77/08*** | (2006.01) |
| ***A47B 47/04*** | (2006.01) |
| ***D06F 29/00*** | (2006.01) |

(52) U.S. Cl.
CPC ..... *A47B 91/02* (2013.01); *A47B 2210/16* (2013.01); *A47B 2210/17* (2013.01); *D06F 29/00* (2013.01)

(56) References Cited

U.S. PATENT DOCUMENTS

| | | | | | |
|---|---|---|---|---|---|
| 4,944,627 | A * | 7/1990 | Durney | F16B 12/2063 | 403/10 |
| 5,042,458 | A * | 8/1991 | Spencer | F24C 15/2042 | 126/21 A |
| 5,795,043 | A * | 8/1998 | Johnson | B01L 1/50 | 312/229 |
| 5,967,634 | A * | 10/1999 | Baca | F24C 15/30 | 126/273 A |
| 6,427,966 | B1 * | 8/2002 | Blumenschein | A47B 91/005 | 248/646 |
| 6,672,690 | B1 | 1/2004 | Williams | | |
| 6,769,750 | B2 * | 8/2004 | Hughes | A47B 47/042 | 312/265.5 |
| 6,820,850 | B2 * | 11/2004 | Coleman | B65D 19/0002 | 248/346.06 |
| 7,748,682 | B2 * | 7/2010 | Hunke | D06F 39/12 | 248/346.05 |
| 7,810,782 | B1 * | 10/2010 | Driscoll | D06F 39/125 | 248/346.01 |
| 9,499,933 | B2 * | 11/2016 | Deryckere | D06F 95/00 | |
| 2005/0082954 | A1 * | 4/2005 | Dunbar | A47B 77/04 | 312/228 |
| 2008/0224581 | A1 * | 9/2008 | Minerva | A47B 97/00 | 312/229 |
| 2010/0253195 | A1 * | 10/2010 | Owens | A47B 47/042 | 312/351.2 |
| 2016/0230919 | A1 * | 8/2016 | Gandole | A47L 15/4272 | |

FOREIGN PATENT DOCUMENTS

| | | | | | |
|---|---|---|---|---|---|
| DE | 3941687 | A1 | 6/1991 | | |
| DE | 19838630 | A1 * | 3/2000 | | A47B 91/005 |
| DE | 20101254 | U1 | 4/2001 | | |
| DE | 20302572 | U1 | 4/2003 | | |
| DE | 102013205747 | A1 * | 10/2014 | | F24C 15/30 |
| DE | 102015105838 | A1 * | 10/2016 | | A47B 77/08 |
| EP | 1175167 | | 1/2002 | | |
| WO | WO-9718731 | A1 * | 5/1997 | | A47B 77/00 |

OTHER PUBLICATIONS

Ikea, "Besta", http://res.ikeaddict.com/products/b/besta-shelf-unit_AA-199377-12_pub/besta-shelf-unitAA-199377-12pub.pdf, pp. 1-20.

https://web.archive.org/web/20160305123536/http://www.jbstahldesign.de/index.php/produkte/waschen, (Relevant for reasons mentioned in International Search Report).

* cited by examiner

PIECE OF FURNITURE IN WHICH A WASHING MACHINE CAN BE PLACED AND METHOD FOR MANUFACTURE THEREOF

CROSS-REFERENCE TO RELATED APPLICATIONS

This application is the United States national phase of International Application No. PCT/EP2017/075693 filed Oct. 9, 2017, and claims priority to European Patent Application No. 16192967.4 filed Oct. 8, 2016, the disclosures of which are hereby incorporated by reference in their entirety.

BACKGROUND

Technical Field

The invention relates to a piece of furniture in which a washing machine can be placed, comprising two substantially vertical side walls, a substantially horizontal bottom wall, a substantially horizontal top wall and a substantially horizontal carrier for the washing machine, placed between the bottom wall and the top wall.

Technical Considerations

Such a piece of furniture is per se known as a cabinet for a washing machine and is sometimes also referred to as washer cabinet. In such a washer cabinet the bottom wall, the top wall, the side walls and the carrier are generally manufactured from a high-grade, usually wood (fibre)-based, pressed board material. Because a washing machine may vibrate during use, the piece of furniture comes to be under high load.

SUMMARY

It is an object of the invention to improve the per se known piece of furniture of the type stated in the preamble. The object of the invention can in particular be to improve the strength of the per se known piece of furniture.

This object is achieved with a piece of furniture of the type stated in the preamble, which is characterized according to the invention in that the side walls are placed on top of the bottom wall. Placing the side walls on top of the bottom wall instead of adjacently of and against the bottom wall, as in usual construction methods, results in a structure which is able to bear a load and transmit this load to the bottom wall without fixing means between the side walls and the bottom wall concentrating the load. Distributing the load over a larger surface area of the bottom wall results in a lower pressure at the same load, which does not result in damage to the piece of furniture, even if the load is so high that in usual construction methods this would be the case.

In an embodiment of the piece of furniture according to the invention the bottom wall is provided with means for placing the bottom wall level on a ground surface. By placing the piece of furniture level the piece of furniture including washing machine remains balanced despite vibrations caused by the washing machine. Not placing the piece of furniture level can result in movement of the piece of furniture, which may result in damage to the piece of furniture and/or the washing machine.

In an embodiment of the piece of furniture according to the invention the means for placing the bottom wall level on a ground surface are height-adjustable legs. Because the legs are height-adjustable it is possible to set a height for each leg which results in a level bottom wall.

In an embodiment of the piece of furniture according to the invention the height-adjustable legs are provided with or manufactured from a plastic. By providing a plastic or manufacturing from plastic, the leg damps vibrations of the piece of furniture and prevents sliding of the piece of furniture over the ground surface, whereby damage is prevented and noise limited.

In an embodiment of the piece of furniture according to the invention the side walls are provided with mounting means placed close to a side situated at the rear during use of the piece of furniture, referred to as the rear side. Providing the piece of furniture with mounting means close to a rear side enables the piece of furniture to be mounted on a rear wall to enable substantially horizontal forces to be countered. A horizontal force on the piece of furniture which engages higher than the floor surface can displace and/or tilt the piece of furniture, which can result in noise and/or damage to the piece of furniture and/or the washing machine. By also placing the mounting means at a position higher than the carrier and lower than the upper plate these horizontal forces can be transferred to the rear wall.

In an embodiment of the piece of furniture according to the invention the mounting means are furniture brackets or corner bracings provided with a soft material. The use of furniture brackets or corner bracings results in a strong connection between rear wall and side walls which is able to absorb horizontal forces. Vibrations caused by the washing machine are damped by the soft material so that a possibly fragile rear wall is protected against such vibrations.

In an embodiment of the piece of furniture according to the invention the carrier is fixed at a distance above the bottom wall, thus forming a storage space between the bottom wall and the carrier. The distance can amount to more than 40 centimetres and is preferably in the order of 50 centimetres, whereby the upper surface of the carrier is situated about 55 centimetres above the ground surface. Placing the carrier higher than the bottom wall makes the washing machine more easily accessible to a user, who is then required to bend down less far in order to load and unload the washing machine, and creates an extra storage space below the carrier. Moreover, this placement allows the carrier, which is fixedly connected to the side walls on opposite sides, to act as a brace and provide additional stiffness and stability to the piece of furniture.

In an embodiment of the piece of furniture according to the invention one or more support means for transmitting vertical forces are placed between the bottom wall and the carrier. Placing support means between the bottom wall and carrier enables vertical forces to be transferred from the carrier to the bottom wall in effective manner, without heavily loading the side walls herein.

In an embodiment of the piece of furniture according to the invention the one or more support means between the bottom wall and the carrier are plate-like and placed substantially parallel to the side walls and/or the rear side. Giving the support means a plate-like form results in a distribution of the vertical forces over a relatively large surface area, while only a small amount of the storage space is taken up by the support means.

In an embodiment of the piece of furniture according to the invention the storage space between the bottom wall and carrier is provided with a drawer. Providing the storage space with a drawer results in a closable storage space. Because a drawer can be loaded from above and the storage space is situated close to floor level, the user has easy access.

In an embodiment of the piece of furniture according to the invention at least the carrier is protected against moisture so as to prevent damage thereto, for instance by paint, a coating or an otherwise watertight layer. Other parts of the piece of furniture can also be protected against moisture in similar manner. Protecting parts of the piece of furniture against moisture extends the lifespan of the piece of furniture since moisture can have an adverse effect on the strength of parts of the piece of furniture, for instance due to rust or rotting. It is effective to protect mainly those parts which are most likely to be exposed to moisture and which have a load-bearing function.

In an embodiment of the piece of furniture according to the invention this is achieved partly in that the carrier is provided on its upper side with a cover plate, particularly a metal cover plate. Providing the carrier with a (metal) cover plate protects the plate material of the carrier against moisture, while the carrier constructed of plate material and metal is at the same time strong enough to carry the load of the washing machine. The extra weight of the metal cover plate provides additional resistance against vibrations. The metal cover plate itself of course also has to be protected against moisture, for instance by a coating or other surface treatment. A fibre-reinforced plastic could also be used as material for the cover plate, instead of metal. Such a plastic is likewise strong and stiff and well able to withstand moisture.

In one embodiment, the piece of furniture according to the invention is provided with a retaining member arranged at a front side of the carrier. Owing to the presence of such a retaining member, a washing machine which is placed on the carrier cannot slide off the plate due to vibrations and consequently fall. The retaining member may be substantially L-shaped and may include an upright edge which also provides additional stiffness. The cover plate can also be provided with upright edges along the sides, which prevents moisture penetrating into the plate material of the side walls and/or of the support means.

In an embodiment of the piece of furniture according to the invention the carrier has a length which is smaller, as measured from the front side of the carrier to the rear side of the carrier, than the depth of the piece of furniture, so that the carrier leaves a space on the rear side. Leaving space between the carrier and the rear wall creates space for conduits which have to be laid from the machine to lower-lying connecting points. For conduits which have to be connected adjacently of and outside the piece of furniture a recess can be made in the side walls of the piece of furniture. The piece of furniture can in that case on the other hand also be placed clear of the rear wall by several centimetres. This can be achieved by choosing a suitable length and/or a suitable location for the mounting means.

In an embodiment of the piece of furniture according to the invention the front and/or rear side is at least partially open. Leaving the front and/or rear side partially open may result in easy access to the washing machine and the door therein from the front side. On the rear side, a part which has been left open can provide space for conduits. The use of less material (particularly on the rear side, since this is not visible) saves material costs. As a result of the presence of the carrier, which provides strength and stiffness, both the front and the rear side may be left open without substantially affecting the stability of the piece of furniture.

In an embodiment of the piece of furniture according to the invention an add-on to the piece of furniture, with side walls and a front side lying substantially in the same plane as the side walls and the front side of the washer cabinet, is placed on the top wall. Adding an add-on above the washer cabinet creates an additional (optionally closable) storage space. Because the storage space is situated high up, it is difficult to reach for children and thus suitable for detergents which have to be kept out of reach of children. The piece of furniture in this way further results in a more efficient use of the floor area.

In an embodiment of the piece of furniture according to the invention the top wall is provided with a ventilation opening. Hot air can convect through the ventilation opening. The washing machine then remains cool, and fire safety is increased. The position of the ventilation opening in the top wall is advantageous, since hot air will convect upward. If an add-on is placed on the washer cabinet, this add-on has to have an in any case locally indented rear wall so as not to block the hot air flow from the ventilation opening.

In another embodiment of the piece of furniture according to the invention the bottom wall and/or side walls and/or top wall are mutually connected with steel fixing means. Using steel fixing means results in a more rigid construction than is possible with for instance aluminium fixing means, as are usual in furniture. The stronger connections ensure that parts of the piece of furniture remain more closely connected to each other, even when one or more parts vibrate because of the washing machine. Counteracting these vibrations prevents damage to the piece of furniture.

The invention further relates to a method for manufacturing a piece of furniture as described above. According to the invention, this method comprises the following steps of: providing the horizontal bottom wall, placing the vertical side walls on top of the bottom wall, arranging the carrier between the side walls and at a distance above the bottom wall, and placing the top wall at a distance above the carrier.

An embodiment of the method according to the invention is distinguished by the placing of vertical support means on the bottom wall after the bottom wall has been provided and before the side walls have been placed, and the placing of the carrier on the support means. In this way the bottom wall, the support means and the carrier may form a sub-frame, and the side walls may then be fixedly connected to this sub-frame.

BRIEF DESCRIPTION OF THE DRAWINGS

The invention will be further elucidated on the basis of a number of exemplary embodiments, wherein reference is made to the accompanying drawing, in which.

DETAILED DESCRIPTION

Figure 1:
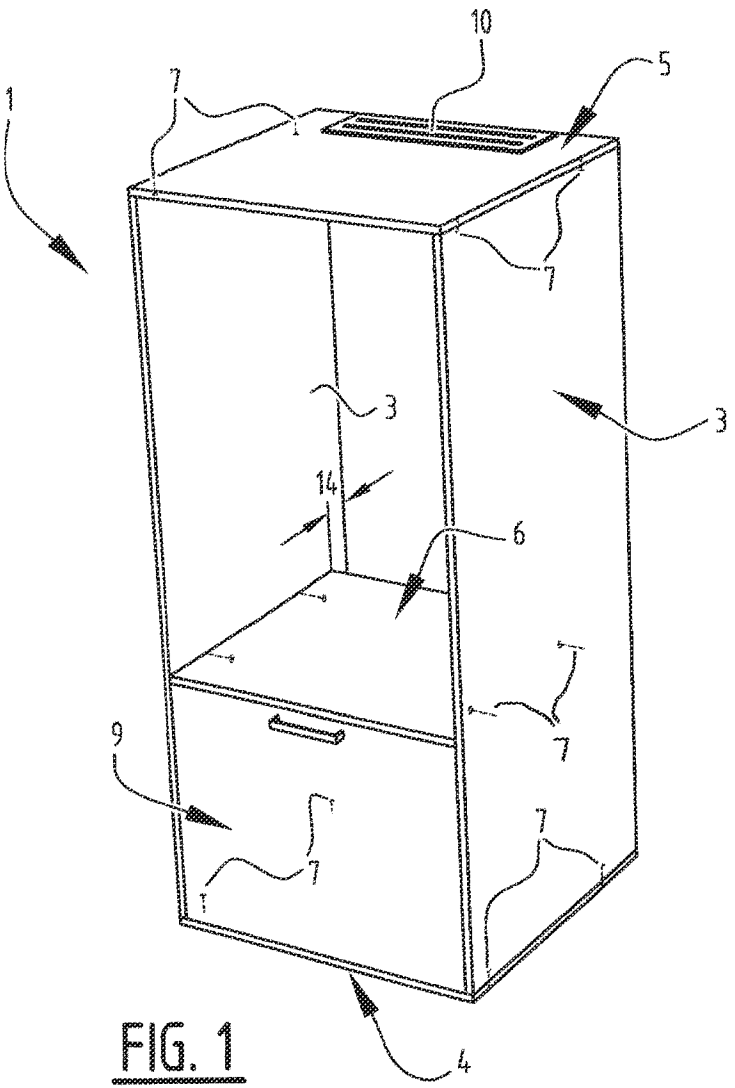
FIG. 1 is a schematic perspective view of a piece of furniture according to a first embodiment of the invention.

FIG. 1 shows that a piece of furniture 1 for accommodating a washing machine 2 comprises a bottom wall 4 on which side walls 3 are placed. This is therefore a clear difference relative to conventional pieces of furniture, wherein the side walls are fixed against the end surfaces of the bottom wall. The placing of side walls 3 on bottom wall 4 results in a considerably stronger and more rigid construction of piece of furniture 1. A carrier 6 for washing machine 2 is arranged between and fixedly connected to side walls 3. An top wall 5 is placed on side walls 3. Carrier 6 is in this example arranged at a distance from bottom wall 4, this resulting in a storage space 15 between bottom wall 4 and carrier 6. Storage space 15 is here provided with a drawer 9. Side walls 3 are in this embodiment fixed to top wall 5, to carrier 6 and to bottom wall 4 by means of steel fixing means 7, which provide for a particularly great rigidity and strength in the connections between the different parts. Top wall 5 is here further provided with a ventilation opening 10 for discharging hot air created during use of washing machine 2.

Figure 2:
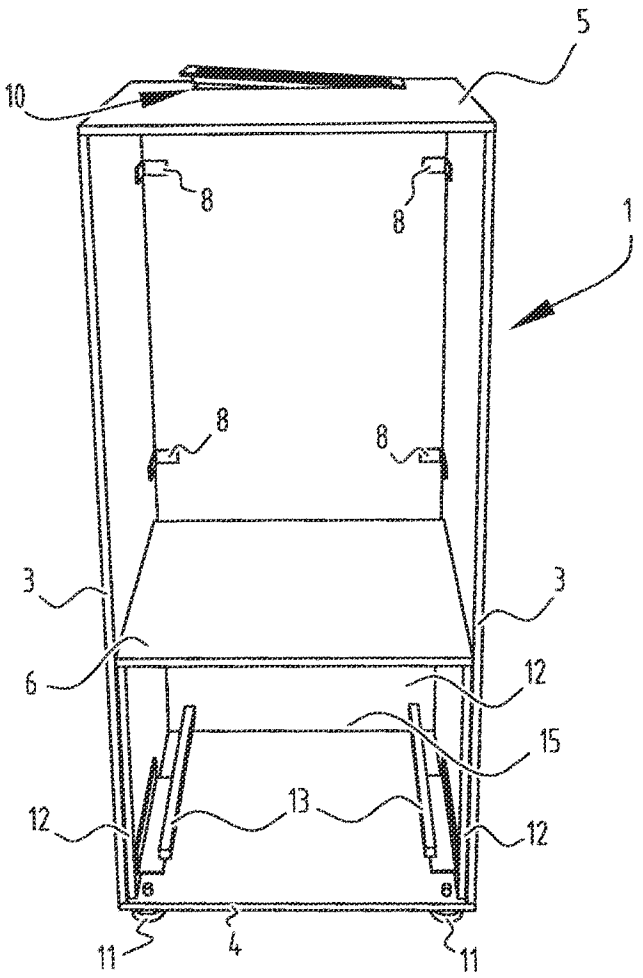
FIG. 2 is a schematic perspective view of a piece of furniture according to another embodiment of the invention, comprising mounting means and height-adjustable legs and support means.

FIG. 2 shows that the storage space between bottom wall 4 and carrier 6 is provided in this example with sliding means 13 for drawer 9. Bottom wall 4 is also provided here with height-adjustable legs 11, and side walls 3 are provided with mounting means 8 close to the rear side. Support means 12 on which carrier 6 is placed are in this embodiment placed on top of bottom wall 4. As seen in FIG. 2, both the support means 12 and the side walls 3 rest upon the bottom wall 4, such that the support means 12 are supported by and in direct contact with the bottom wall 4. Support means 12 here take the form of vertical wall parts, two of which are parallel to and connected to side walls 3, while the third vertical wall part forms a rear wall of storage space 15 under carrier 6. Carrier 6 thus rests on support means 12 along three of its edges. Together, the support means 12, side walls 3 and carrier 6 form a frame which is both strong and stiff.

Figure 3:
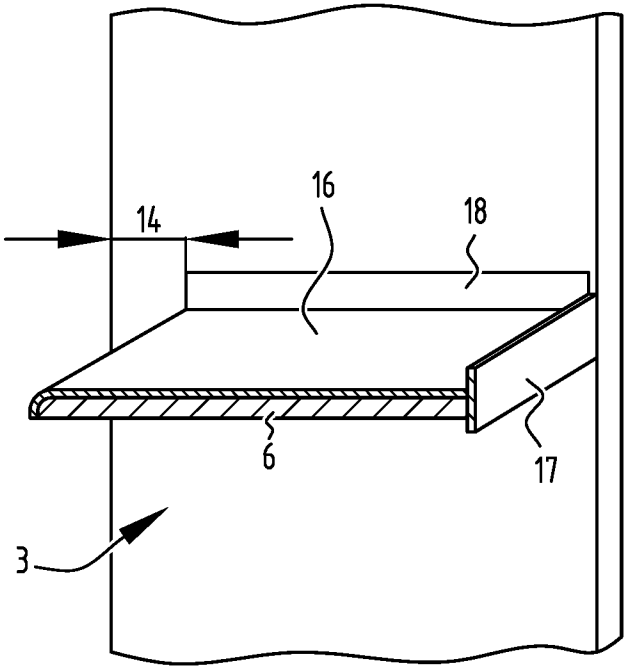
FIG. 3 is a schematic and partial cross-sectional perspective view of a side wall and the carrier with a metal cover plate provided with upright edges and a retaining member.

FIG. 3 shows one of the two side walls 3 and carrier 6 in detail. It can be seen that carrier 6, which can be manufactured from a high-grade wood-based plate material, is provided on its upper side with a cover plate 16 of metal or of a fibre-reinforced plastic. The cover plate has an upright front edge 17 and upright side edges 18. These upright edges protect the surrounding structure against being penetrated by moisture which could leak from washing machine 2. In addition, upright front edge 17 prevents washing machine 2 falling from carrier 6 due to vibration. Cover plate 16 further has a downward bent end edge 19 which protects the corresponding side of carrier 6 against the effects of moisture.

Carrier 6 has a length, calculated from its front side to its rear side, which is smaller than the depth of piece of furniture 1, whereby a space 14 remains between the rear side of carrier 6 and the rear side of piece of furniture 1. This space can serve for feeding conduits through.

Figure 4:
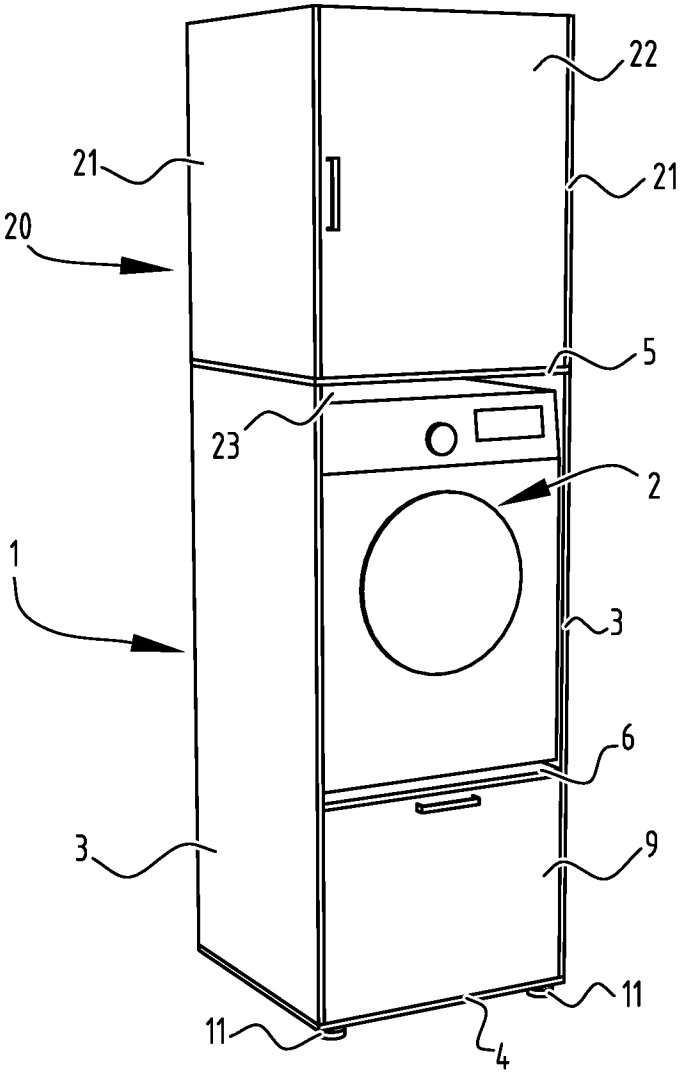
FIG. 4 is a schematic perspective view of another embodiment of the invention with a washing machine therein and an add-on thereon.

FIG. 4 shows another embodiment of washer cabinet 1 according to the invention with an add-on 20 which is placed on top wall 5. Add-on 20 is provided with side walls 21 lying in the same plane as side walls 3 of washer cabinet 1 and with a front side—defined here by a door 22—lying in the same plane as the front side of the washer cabinet. The add-on thus has the same outer dimensions as the washer cabinet, in this example a width of 67 centimetres and a depth of 65 centimetres. These are not common dimensions for a piece of furniture, but they provide the required interior space for placing washing machine 2. Add-on 20 further has a conventional construction, with side walls 21 which are fixed on either side of the (non-visible) bottom wall and top wall. The rear wall (not visible here) of the add-on can however in any case be offset to the front relative to the rear side of side walls 20 to some extent so as to enable hot air from the washing machine to be discharged. It can otherwise be seen in this example that washing machine 2 is indeed placed in washer cabinet 1. A gap 23 through which hot air can likewise escape is left between washing machine 2 and top wall 5.

Figure 5:
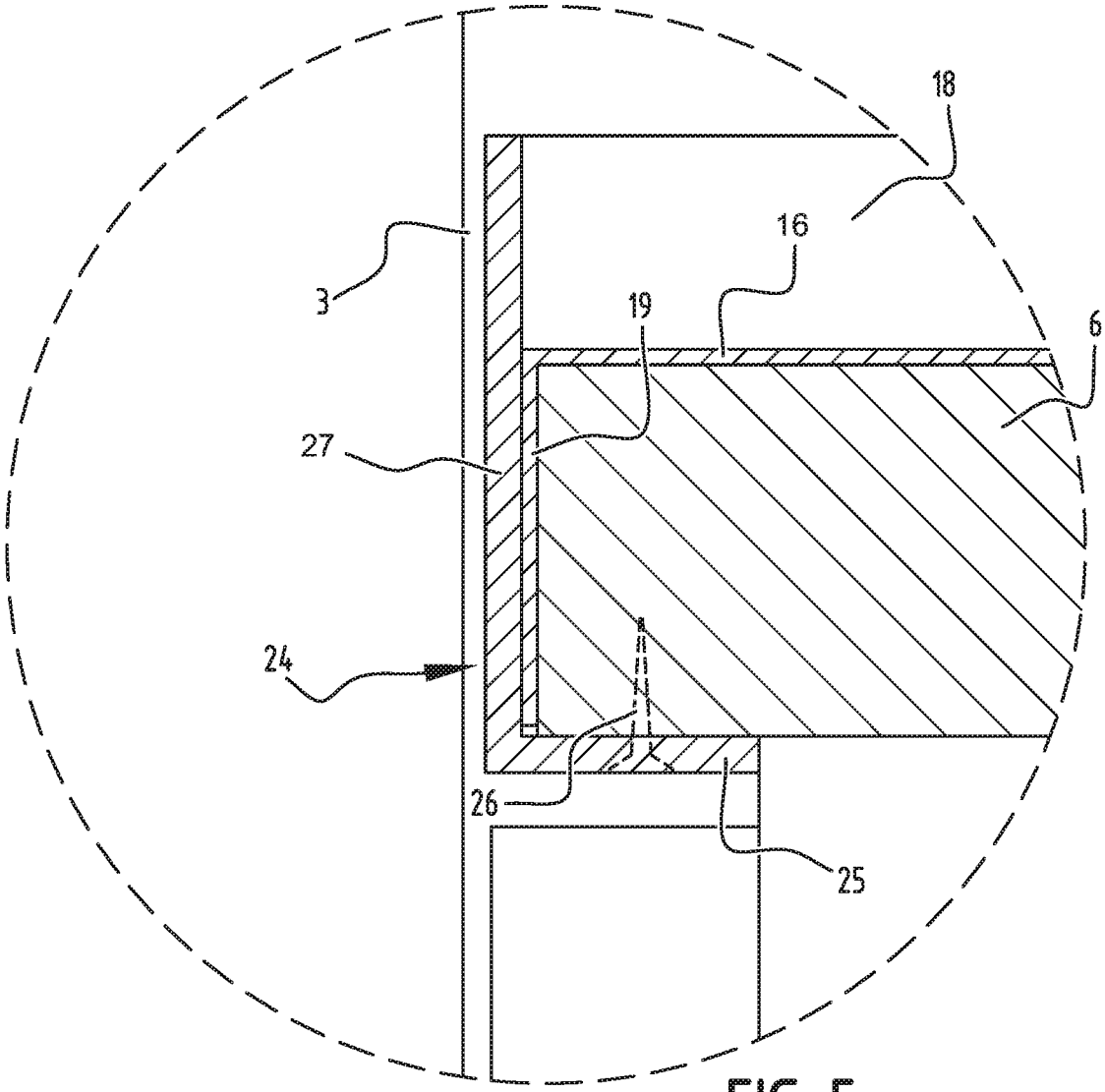
FIG. 5 is a longitudinal sectional view of another embodiment of the carrier, cover plate and retaining member.

In FIG. 5 an alternative arrangement of the piece of furniture 1 is shown, in which the carrier 6 is covered by a plate 16 which not only has a downward bent edge 19 at the rear, but also at the front. In this embodiment the retaining member 24 is formed by an L-shaped metal strip having an upright leg 27 extending in front of the carrier 6 and the bent edge 19 of the cover plate 16, and a horizontal leg 25 extending below the carrier 6. This horizontal leg 25 is fixedly connected to the carrier 6 by a number of connectors 26, e.g. screws.

Although this application refers repeatedly to a washing machine, the piece of furniture can also be used for placing a tumble dryer, combo washer or washer dryer therein.

Although the invention has been elucidated above on the basis of a number of embodiments, it will be apparent that these can be varied in many ways. The scope of the invention is therefore defined solely by the following claims.

The invention claimed is:

1. A piece of furniture for a washing machine, comprising:
- two substantially vertical side walls,
- a substantially horizontal bottom wall,
- a substantially horizontal top wall,
- a substantially horizontal carrier for the washing machine, placed between the bottom wall and the top wall,
- wherein the side walls are placed on top of the bottom wall,
- one or more support means for transmitting vertical forces placed between the bottom wall and the carrier, wherein the one or more support means are plate-shaped and are adjacent to and parallel to the side walls and wherein the one or more support means are supported by and in direct contact with the bottom wall, and
- a retaining member arranged at a front side of the carrier, wherein the retaining member is formed by an L-shaped metal strip having an upright leg extending in front of the carrier and a horizontal leg extending below the carrier, wherein the horizontal leg is fixedly connected to the carrier.

2. The piece of furniture as claimed in claim 1, wherein the bottom wall is provided with means for placing the bottom wall level on a ground surface.

3. The piece of furniture as claimed in claim 2, wherein the means for placing the bottom wall level on a ground surface are height-adjustable legs.

4. The piece of furniture as claimed in claim 3, wherein the height-adjustable legs at least partially comprise plastic.

5. The piece of furniture as claimed in claim 1, wherein the side walls are provided with mounting means placed close to a rear side thereof.

6. The piece of furniture as claimed in claim 5, wherein the mounting means are furniture brackets or corner bracings provided with a soft material.

7. The piece of furniture as claimed in claim 1, wherein the carrier is fixed at a distance above the bottom wall, thus forming a storage space between the bottom wall and the carrier.

8. The piece of furniture as claimed in claim 7, wherein the storage space is provided with a drawer.

9. The piece of furniture as claimed in claim 1, wherein the one or more support means are plate-like and placed substantially parallel to the side walls and/or a rear side.

10. The piece of furniture as claimed in claim 1, wherein at least the carrier is protected against moisture.

11. The piece of furniture as claimed in claim 1, wherein the carrier is provided on an upper side thereof with a cover plate.

12. The piece of furniture as claimed in claim 1, wherein the carrier has a length from a front side of the carrier to a rear side of the carrier, which is smaller than a depth of the piece of furniture.

13. The piece of furniture as claimed in claim 1, wherein at least a part of a front and/or rear side is open.

14. The piece of furniture as claimed in claim 13, wherein at least a part of both the front side and the rear side is open.

15. The piece of furniture as claimed in claim 1, wherein the top wall is provided with a ventilation opening.

16. The piece of furniture as claimed in claim 1, wherein the bottom wall and/or side walls and/or top wall are mutually connected by means of steel fixing means.

17. A method for manufacturing the piece of furniture as claimed in claim 1, comprising:

providing the horizontal bottom wall, placing the vertical side walls on top of the bottom wall, arranging the carrier between the side walls and at a distance above the bottom wall, and placing the top wall at a distance above the carrier.

18. The method as claimed in claim 17 for manufacturing the piece of furniture, further comprising:

placing the one or more support means on the bottom wall after the bottom wall has been provided and before the side walls have been placed, and placing the carrier on the one or more support means.

19. The piece of furniture as claimed in claim 1, wherein both the one or more support means and the side walls rest upon the bottom wall.

20. The piece of furniture as claimed in claim 1, wherein the one or more support means are connected to the side walls.

* * * * *